US011278918B2

(12) United States Patent
Pearl

(10) Patent No.: US 11,278,918 B2
(45) Date of Patent: Mar. 22, 2022

(54) FLOW DIVIDER JET-INTENSIFIER

(71) Applicant: Nozzle Dynamics, LLC, Bowling Green, KY (US)

(72) Inventor: Zachary D. Pearl, Scottsville, KY (US)

(73) Assignees: Nozzle Dynamics, LLC, Bowling Green, KY (US); WV Jet Drilling, LLC, Spencer, WV (US)

( * ) Notice: Subject to any disclaimer, the term of this patent is extended or adjusted under 35 U.S.C. 154(b) by 122 days.

(21) Appl. No.: 16/007,259

(22) Filed: Jun. 13, 2018

(65) Prior Publication Data

US 2018/0361402 A1 Dec. 20, 2018

Related U.S. Application Data

(60) Provisional application No. 62/606,595, filed on Oct. 2, 2017, provisional application No. 62/603,918, filed on Jun. 16, 2017.

(51) Int. Cl.
*B05B 1/08* (2006.01)
*B05B 3/04* (2006.01)

(52) U.S. Cl.
CPC ..... *B05B 1/083* (2013.01); *B05B 3/0404* (2013.01)

(58) Field of Classification Search
CPC ..... B05B 1/083; B05B 3/0404; B05B 3/06; E21B 37/04; E21B 37/06; B08B 9/0433
See application file for complete search history.

(56) References Cited

U.S. PATENT DOCUMENTS 3,004,719 A * 10/1961 Pouppirt, Jr. ..... B05B 7/0861 239/381
RE25,942 E * 12/1965 Reynolds ..... B05B 3/0404 239/206

(Continued)

FOREIGN PATENT DOCUMENTS

WO 2016205956 A1 12/2016

OTHER PUBLICATIONS

Ikonen, T., International Search Report for International Patent Application No. PCT/US2018/037763, dated Sep. 18, 2018, European Patent Office.

(Continued)

*Primary Examiner* — Tuongminh N Pham
(74) *Attorney, Agent, or Firm* — Jackson Walker, LLP

(57) ABSTRACT

The present invention provides a flow insert and improved flow tube, such as a nozzle, that divides flow by generating an interrupted flow pattern, including pressure/energy gradients, in the otherwise uninterrupted flow of high pressure water through the nozzle. Cutting, cleaning, and boring performance is substantially improved. The interrupted flow pattern can provide for egress of cut or broken material to get out of the way, so cutting or cleaning action is not hampered by a continuous flow of high-pressure water. One or more balls circumferentially rotating around a ball-track assembly having a track support within the flow tube causes the flow interruption. When the flow is interrupted, the interruption's trailing edge (that is, the flow's restarting edge after the interruption) provides stronger cutting action than a continuous solid jet. The flow tube can be used for a broad array of industrial cleaning, surface preparation, cutting, and boring/drilling applications.

20 Claims, 9 Drawing Sheets

(56) References Cited

U.S. PATENT DOCUMENTS

| | | | | |
|---|---|---|---|---|
| 4,787,465 | A | 11/1988 | Dickinson, III et al. | |
| 4,796,815 | A | 1/1989 | Greenberg | |
| 5,505,262 | A | 4/1996 | Cobb | |
| 5,853,056 | A | 12/1998 | Landers | |
| 5,862,871 | A | 1/1999 | Curlett | |
| 6,029,746 | A * | 2/2000 | Dodd | B08B 9/0433 166/222 |
| 6,263,984 | B1 | 7/2001 | Buckman, Sr. | |
| 6,668,948 | B2 | 12/2003 | Buckman, Sr. et al. | |
| 2007/0033725 | A1 * | 2/2007 | Holtsnider | A61H 33/6057 4/541.6 |

OTHER PUBLICATIONS

Daintith, E., Written Opinion for International Patent Application No. PCT/US2018/037763, dated Sep. 18, 2018, European Patent Office.

* cited by examiner

FLOW DIVIDER JET-INTENSIFIER

CROSS REFERENCE TO RELATED APPLICATIONS

This application claims the benefit of U.S. Provisional Appl. No. 62/603,918, filed Jun. 16, 2017, entitled "Swirling Vortex Jet", and U.S. Provisional Appl. No. 62/606,595, filed Oct. 2, 2017, entitled "Flow Divider Jet-Intensifier".

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to high-pressure flow tubes, such as nozzles, through which pressurized fluids flow. More particularly, the disclosure relates to high-pressure flow tubes using pressurized fluids for impacting surfaces, such as for cleaning surfaces or boring through surfaces.

Description of the Related Art

High-pressure waterjets and related equipment serve a broad array of industrial cleaning, surface preparation, cutting, and boring/drilling applications. These applications require a wide variety of tools and equipment. A critical component of the tools is the nozzle. The nozzle's design is crucial to effectively and efficiently produce maximum jet energy for optimum results in the desired application.

FIG. 1 is a schematic illustration of a typical work site layout with a heat exchange bundle. Industrial heat exchanger tubes are cleaned most effectively by high-pressure water blasting. FIG. 2 is a schematic illustration of typical heat exchanger showing a tube coupled to a nozzle entering a tube of the heat exchanger. FIG. 3 is a schematic illustration of typical heat exchanger showing the nozzle exiting the tube of the heat exchanger with a uniform continuous spray pattern used to clean the tube. Typically, a high-pressure pump unit (water-blaster/hydroblaster) delivers high-pressure water through a flexible (or rigid) lance to a nozzle that is specifically designed to fit into and properly clean a tube. There are many different types of nozzles that are used, and the particular design is based on the size and length of the tubes, structural integrity of the tubes, contaminants in the tube (soft to hard), level of cleanliness required, operating pressure, and other factors.

FIG. 4 is a schematic illustration of a hydrocarbon well site with surface equipment and subsurface hydrocarbons. FIG. 5 is a schematic of a high-pressure nozzle boring through a formation laterally from the casing to gain access to the subsurface hydrocarbons. Similarly, high-pressure nozzles can be used to bore holes through the earth's formations for subsurface applications, such as geo-thermal drilling or hydrocarbon well revitalization. The images below depict the use of special high-pressure water nozzles to gain access to hydrocarbon reserves in existing wells.

Another application for high-pressure nozzles is for the process known as "hydroexcavation". Digging in the ground around buried cables and utilities has traditionally been problematic because the machines used to dig in the dirt frequently damage or break the buried cables or pipes. This can be very hazardous, as well as inconvenient for customers who rely on the utilities or services. Hydroexcavation has been developed in recent years and has overcome many of the difficulties traditionally seen when accessing buried cables and utilities. In hydroexcavation, high-pressure water (or air) is forced through a nozzle into the dirt to loosen it and break it up. Then, a vacuum system is used to suck up the loose debris/debris-water mix into a purpose-built vehicle for disposal. The typically nozzle uses a straight jet to cut into the dirt. While the straight jet provides excellent cutting performance, it still has potential to damage the outside of buried cables and pipes because the jet of water is very focused on a small area.

FIG. 6 is a schematic partial cross-sectional view of a known nozzle with an illustrated jet shape. One of the most effective nozzles available in the market today for both of the above noted applications is the Vortex Jet (by Nozzle Dynamics) for heat exchanger tube cleaning, and the Buckman Jet Drill for oil well revitalization. These nozzles are similar and represent the prior art. The prior art nozzle will be referred to as the Vortex Nozzle for the background section. The Vortex Nozzle cleans and cuts by forming a swirling, high velocity cone of water that emanates outwardly and impinges on the tube wall or into the formation. In the case of tube cleaning, this cone produces a uniform and uninterrupted cleaning action that completely cleans the inside of the tube.

FIG. 7 is a schematic partial cross-sectional view of another known nozzle with an illustrated jet shape. FIG. 8 is a schematic perspective cross sectional view of a known nozzle. FIG. 9 is a schematic side cross sectional view of the nozzle of FIG. 8. Body 3 may be formed from any of a number of grades of high-strength or corrosion-resistant steel. A suitable material is 316 Stainless Steel. Other hardening techniques and hard materials may be used for body 3 of nozzle 1. Threaded area 4 may be used as a connector mechanism for attaching the nozzle to a hose or conduit. The direction of fluid flow is from proximal end 2 of nozzle 1 to distal end 9. Chamber 5 provides a flooded, pressurized volume to supply fluid to at least one, and normally many combinations, locations and orientations of orifice 6 typically in the distal end of body 3. High velocity fluid emanating from orifices 6 proceeds outwardly into a tube being cleaned or a hole being drilled or onto a surface to be cleaned at which nozzle 1 is inserted or aimed. The diameter of orifices 6 may be in the range from about 0.010 inch to about 0.060 inch. Size may be adjusted to account for different numbers of orifices used, type of material to be drilled or cleaned, and the desired operating pressure. The angle between the axis of chamber 5 and the axes of the orifices 6 can be directly forward, parallel to the central axis, at an acute angle from the central axis, radially perpendicular, an obtuse angle from the distal-most point of nozzle body 3 at the distal end 9 or some combination of these, such that the number of orifices 6 does not exceed the available flow required to produce the desired pressure needed for the application. Normally, orifices 6 are also arrayed equally around the axis of chamber 5 to maintain a balanced distribution of thrust forces radially, and sometimes axially.

In both illustrations of the known nozzles of FIGS. 6 and 7, rearward facing jets (not shown) angled toward the proximal end 2 push broken and cut material rearwardly, so the nozzle can continue advancing to the other end of its travel.

While the above examples address the underlying need for high-pressure flow and impact on a surface, the efficiency of the flow and effectiveness of the impact are lacking. A solution is needed, and advantageously can include a retrofit solution for existing flow tubes.

SUMMARY OF THE INVENTION

The present invention provides a flow insert and improved flow tube, such as a nozzle, that divides flow by generating an interrupted flow pattern, including pressure/energy gradients, in the otherwise uninterrupted flow of high pressure water through the nozzle. The resulting flow, such as a jet, is intensified. Cleaning, cutting, and boring performance can be substantially improved. The interrupted flow pattern can provide for the relatively easy egress of cut or broken material to get out of the way, so cutting or cleaning action is not hampered by a continuous flow of high-pressure water. One or more balls circumferentially rotating around a ball-track assembly having a track support within the flow tube causes the flow interruption. When the flow is interrupted, the interruption's trailing edge (that is, the flow's restarting edge after the interruption) provides stronger cutting action than a continuous solid jet. The flow tube can be used for a broad array of industrial cleaning, surface preparation, cutting, and boring/drilling applications.

The disclosure provides a flow tube configured to flow an interrupted flow of fluid, comprising: a body having an inlet end and an outlet end, the body having a longitudinal axis and forming a chamber fluidicly coupled between the inlet end and the outlet end; and a ball-track assembly comprising a track support coupled at least partially across the chamber, a ball-track coupled to the track support and protruding along the longitudinal axis, the ball-track forming a contained path for at least one ball in an annular space within the chamber in which a ball can orbit the ball-track as fluid flows through the chamber, the ball-track and ball configured to interrupt a uniform fluid flow toward the outlet end as the ball rotates around the ball track.

The disclosure provides a method of interrupting a flow stream through a flow tube having a body having an inlet end and an outlet end, the body having a longitudinal axis and forming a chamber fluidicly coupled between the inlet end and the outlet end; and a ball-track assembly comprising a track support coupled at least partially across the chamber, a ball-track coupled to the track support and protruding along the longitudinal axis, the ball-track forming a contained path for at least one ball in an annular space within the chamber in which a ball can orbit the ball-track as fluid flows through the chamber, the method comprising: flowing a fluid from the inlet end past the ball-track assembly; causing at least one ball to orbit the ball-track; interrupting the flowing fluid from a uniform flow in the chamber with the at least one ball as the ball orbits the ball-track; and allowing the interrupted flowing fluid to exit the chamber through the outlet end.

DETAILED DESCRIPTION

Figure 1:
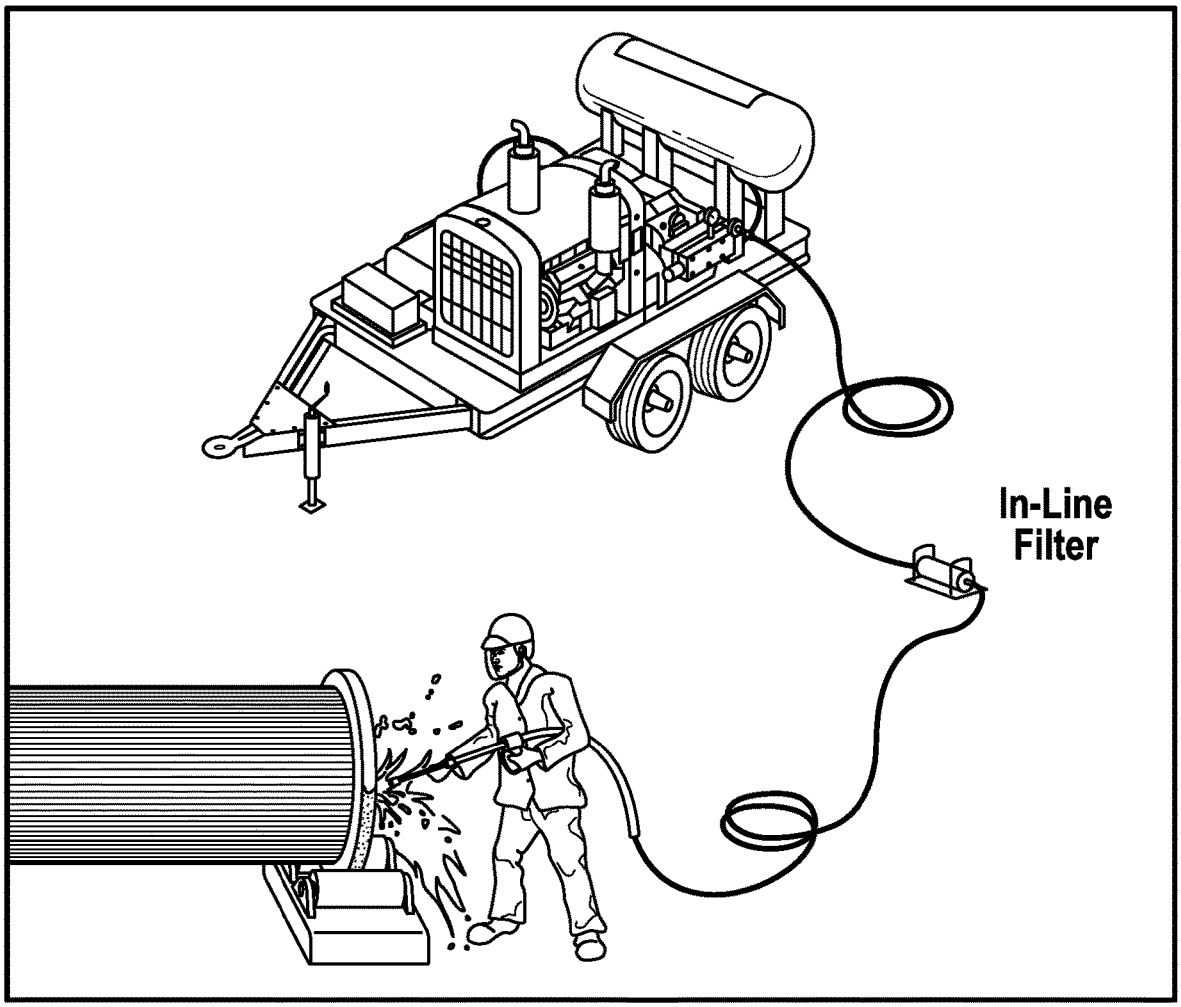
FIG. 1 (Prior Art)
FIG. 1 is a schematic illustration of a typical work site layout with a heat exchange bundle.
Figure 2:
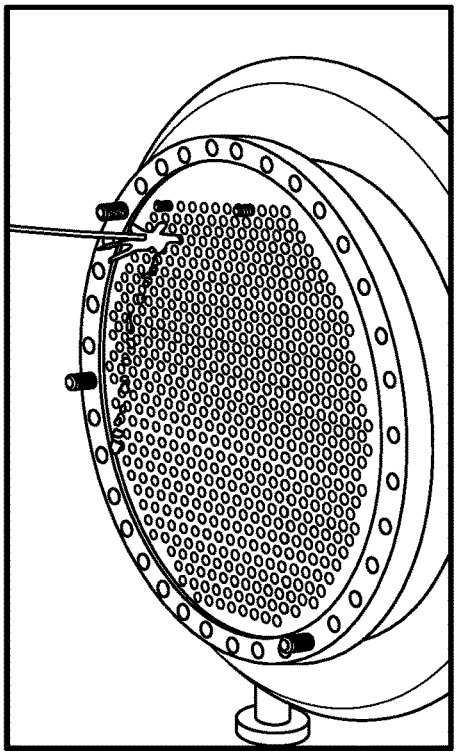
FIG. 2 (Prior Art)
FIG. 2 is a schematic illustration of typical heat exchanger showing a tube coupled to a nozzle entering a tube of the heat exchanger.
Figure 3:
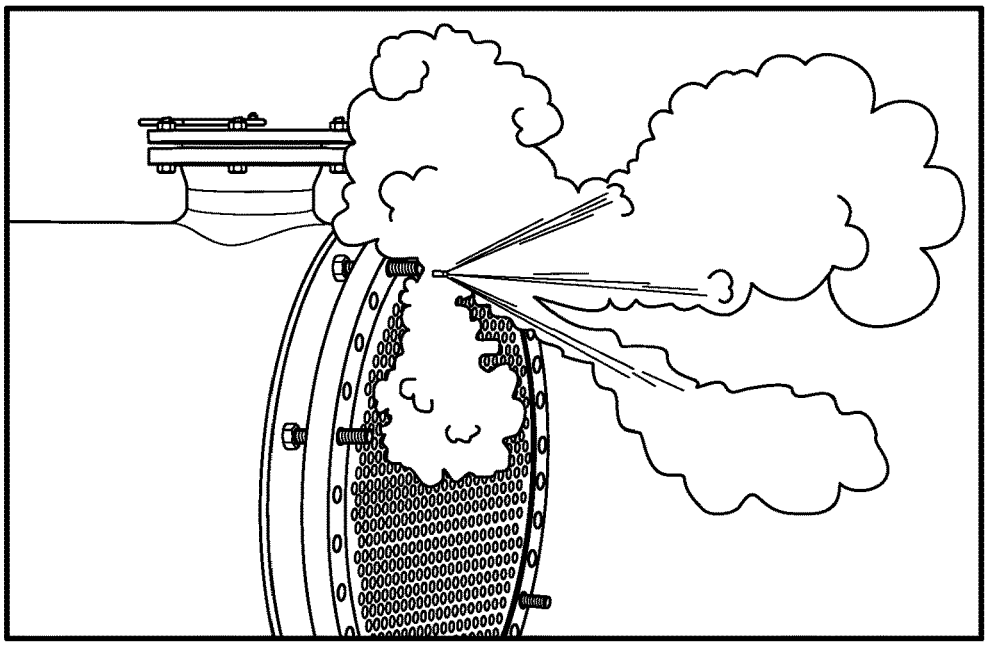
FIG. 3 (Prior Art)
FIG. 3 is a schematic illustration of typical heat exchanger showing the nozzle exiting the tube of the heat exchanger with a uniform continuous spray pattern used to clean the tube.
Figure 4:
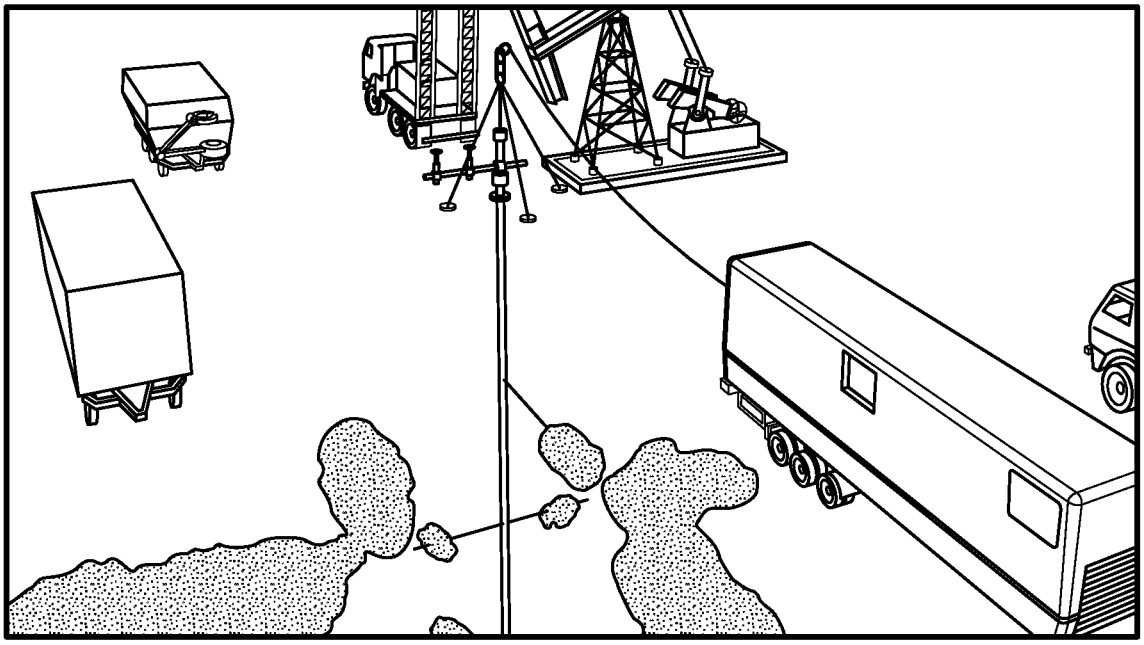
FIG. 4 (Prior Art)
FIG. 4 is a schematic illustration of a hydrocarbon well site with surface equipment and subsurface hydrocarbons.
Figure 5:
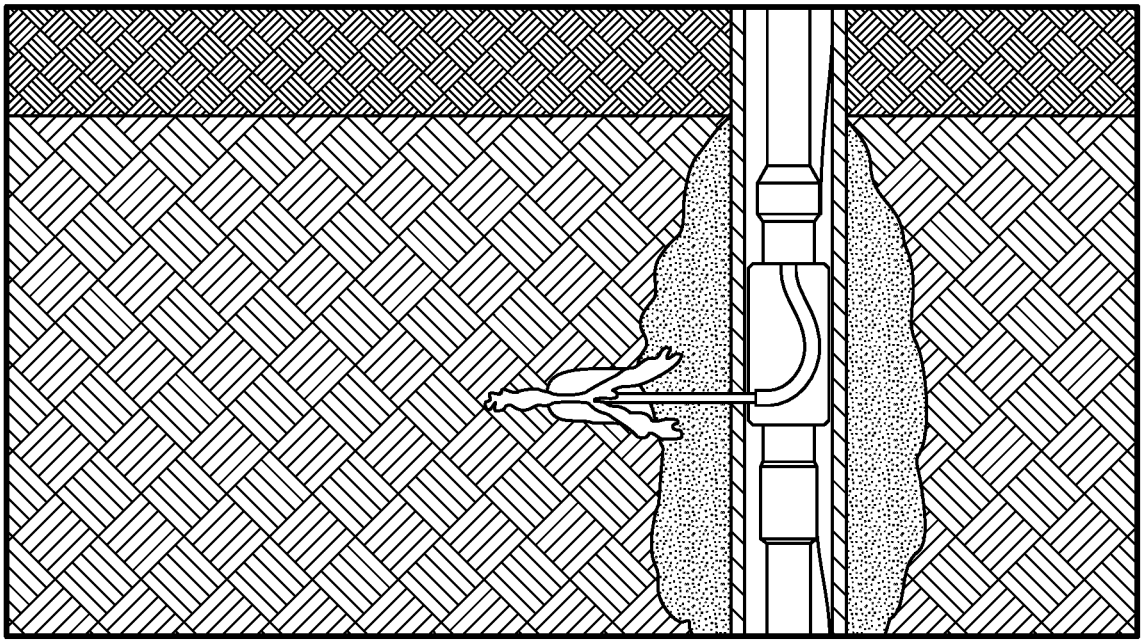
FIG. 5 (Prior Art)
FIG. 5 is a schematic of a high-pressure nozzle boring through a formation laterally from the casing to gain access to the subsurface hydrocarbons.
Figure 6:
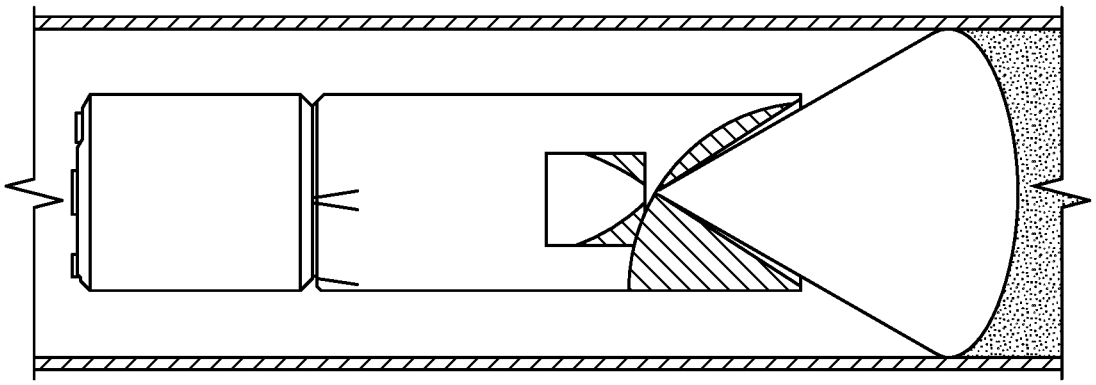
FIG. 6 (Prior Art)
FIG. 6 is a schematic partial cross-sectional view of a known nozzle with an illustrated jet shape.
Figure 7:
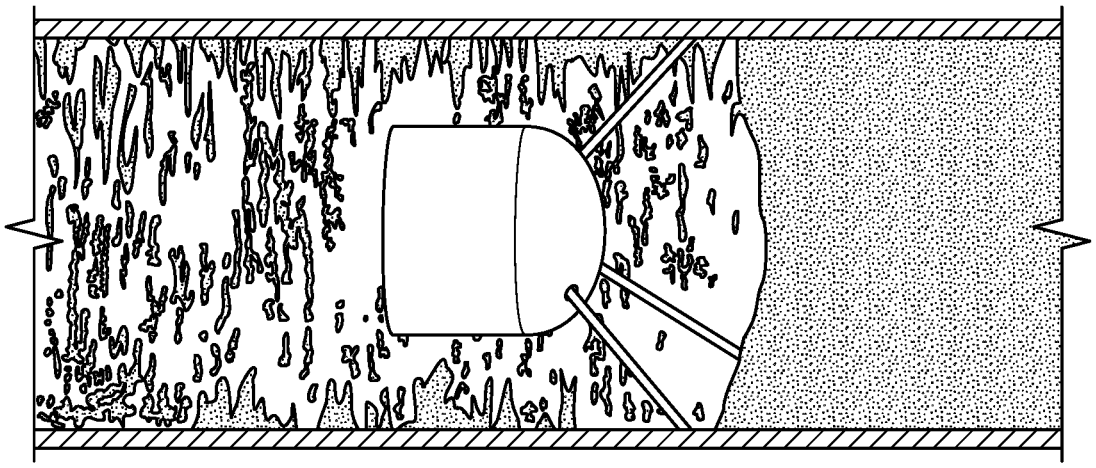
FIG. 7 (Prior Art)
FIG. 7 is a schematic partial cross-sectional view of another known nozzle with an illustrated jet shape.
Figure 8:
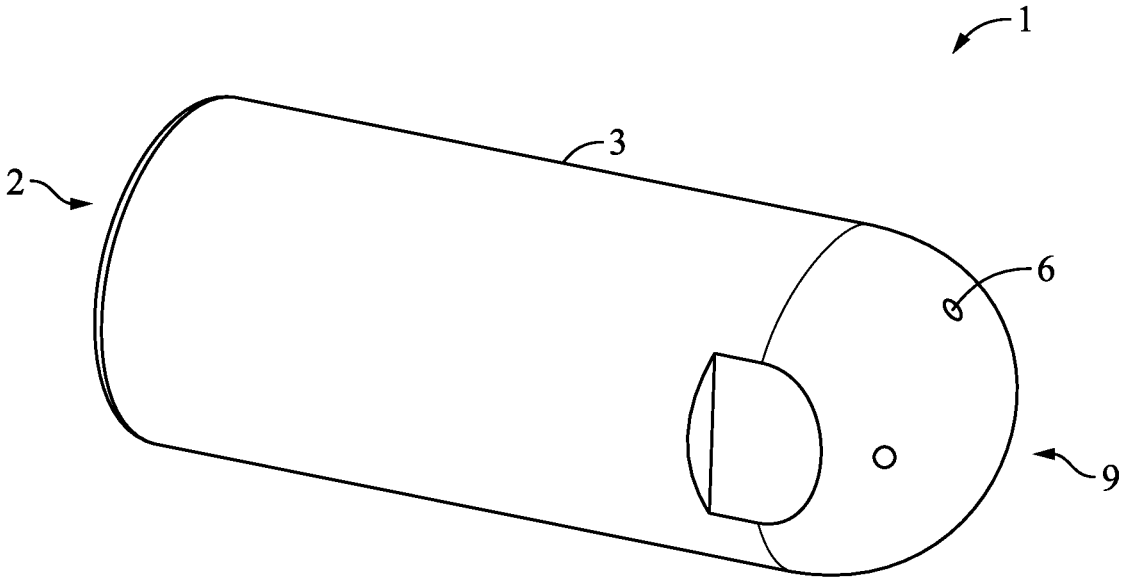
FIG. 8 (Prior Art)
FIG. 8 is a schematic perspective cross sectional view of a known nozzle.
Figure 9:
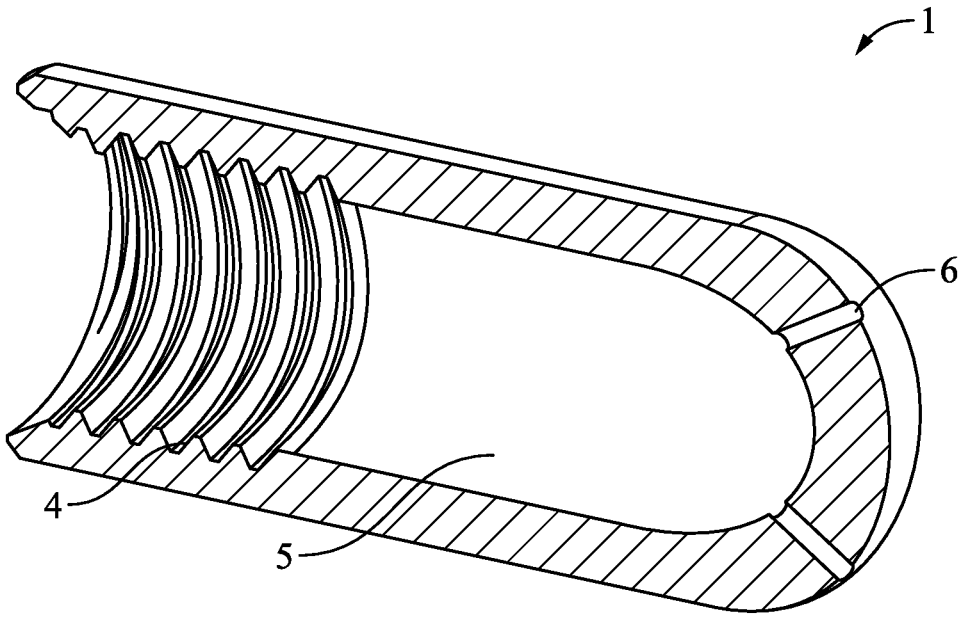
FIG. 9 (Prior Art)
FIG. 9 is a schematic side cross sectional view of the nozzle of FIG. 8.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation or location, or with time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The terms "top", "up', "upward', "bottom", "down", "downwardly", and like directional terms are used to indicate the direction relative to the figures and their illustrated orientation and are not absolute in commercial use but can vary as the assembly varies its orientation. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Some elements are nominated by a device name for simplicity and would be understood to include a system of related components that are known to those with ordinary skill in the art and may not be specifically described. Various examples are provided in the description and figures that perform various functions and are non-limiting in shape, size, description, but serve as illustrative structures that can be varied as would be known to one with ordinary skill in the art given the teachings contained herein. As such, the use of the term "exemplary" is the adjective form of the noun "example" and likewise refers to an illustrative structure, and not necessarily a preferred embodiment.

The present invention provides a flow insert and improved flow tube, such as a nozzle, that divides flow by generating an interrupted flow pattern, including pressure/energy gradients, in the otherwise uninterrupted flow of high pressure water through the nozzle. The resulting flow, such as a jet, is intensified. Cleaning, cutting, and boring performance can be substantially improved. The interrupted flow pattern can provide for the relatively easy egress of cut or broken material to get out of the way, so cutting or cleaning action is not hampered by a continuous flow of high-pressure water. One or more balls circumferentially rotating around a ball-track assembly having a track support within the flow tube causes the flow interruption. When the flow is interrupted, the interruption's trailing edge (that is, the flow's restarting edge after the interruption) provides stronger cutting action than a continuous solid jet. The flow tube can be used for a broad array of industrial cleaning, surface preparation, cutting, and boring/drilling applications. The stronger cutting action at the interruption's trailing edge can be applied to wider flow patterns and retain sufficient energy that may correspond to continuous more focused jet streams. This feature may be useful particularly in boring and hydroexcavation applications.

Figure 10:
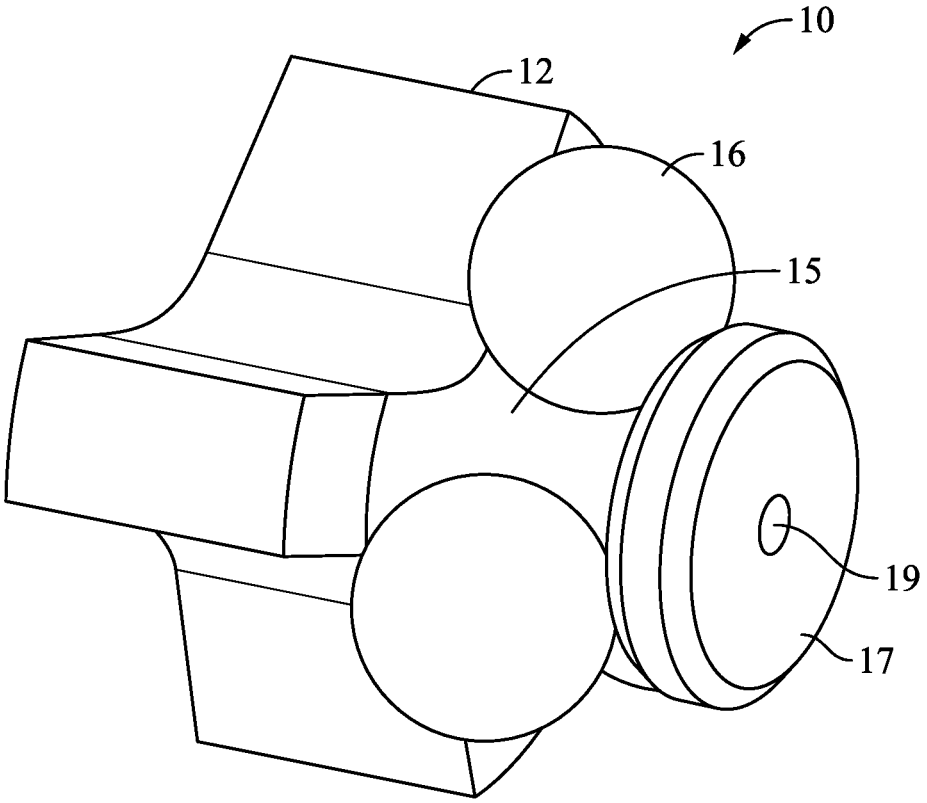
FIG. 10 is a schematic perspective front view of an embodiment of a ball-track assembly of the present invention.
Figure 11:
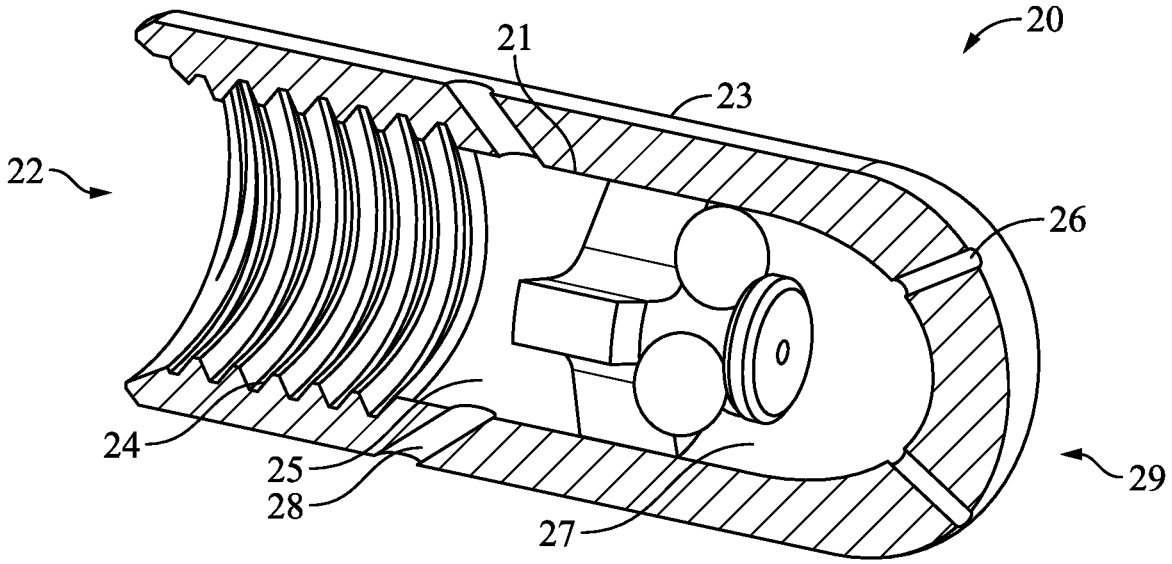
FIG. 11 is a schematic cross-sectional view of a high-pressure flow tube with the ball-track coupled thereto.
Figure 12:
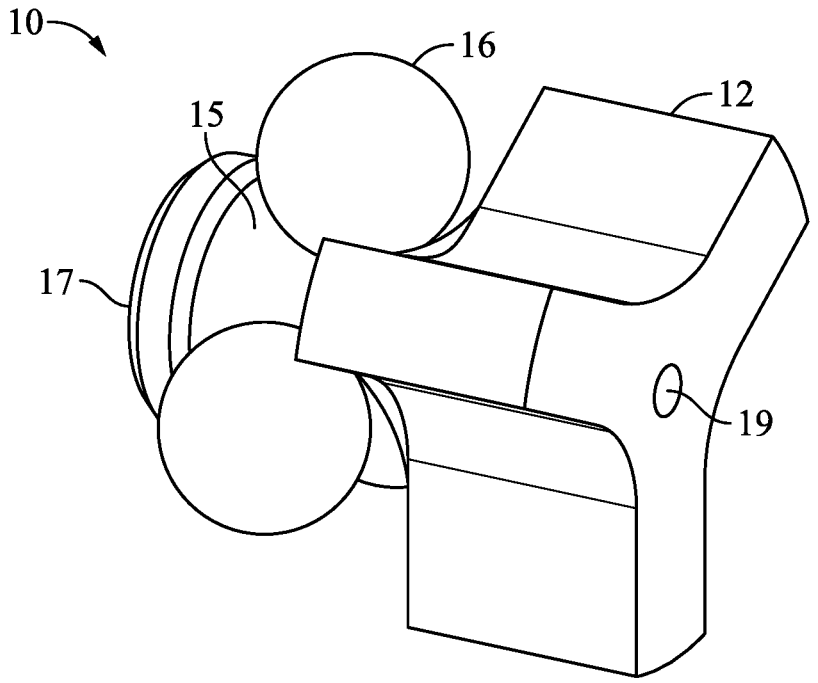
FIG. 12 is a schematic perspective front view of the ball-track assembly of FIG. 10 in a reverse orientation.
Figure 13:
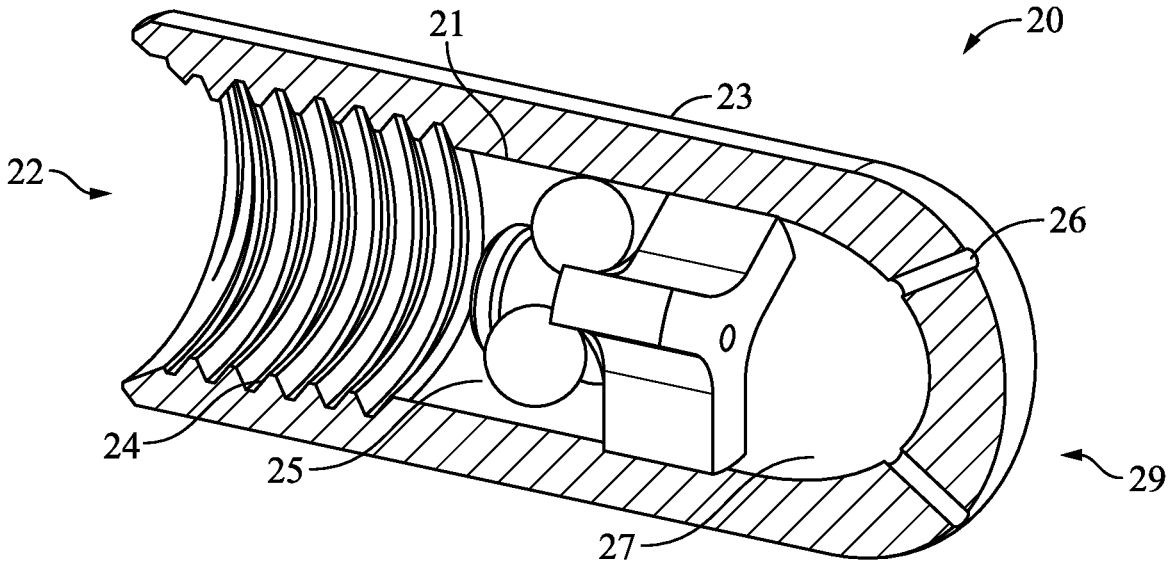
FIG. 13 is a schematic cross-sectional view of the high-pressure flow tube with the reverse oriented ball-track coupled thereto.

FIG. 10 is a schematic perspective front view of an embodiment of a ball-track assembly of the present invention. FIG. 11 is a schematic cross-sectional view of a high-pressure flow tube with the ball-track coupled thereto. FIG. 12 is a schematic perspective front view of the ball-track assembly of FIG. 10 in a reverse orientation. FIG. 13 is a schematic cross-sectional view of the high-pressure flow tube with the reverse oriented ball-track coupled thereto.

Flow tube 20 with a flow divider includes body 23 forming a chamber 21 with a proximal inlet end 22 and a distal outlet end 29. Threaded area 24 on the inlet end 22 can be used as a coupling component for attaching flow tube 20 to a hose or conduit to supply fluid to the flow tube. The direction of fluid flow is generally from proximal inlet end 22 of flow tube 20 to distal outlet end 29. Chamber 21 forms a flooded, pressurized volume to supply fluid to at least one, and normally a plurality of combinations, locations and orientations of orifice 26 generally in the distal outlet end of body 23. High velocity fluid emanating from orifices 26 proceeds outwardly into a tube being cleaned or a hole being drilled or onto a surface to be cleaned at which flow tube 20 is inserted or aimed. As shown in FIG. 11, and also can be applied to FIGS. 13 and 15, rearward facing orifices 28 angled toward the proximal inlet end 22 can flow a portion of the fluid flow in the direction of the proximal end.

A ball-track assembly 10 can be used to create an interrupted flow pattern of an otherwise uniform flow through the flow path of the flow tube 20 by at least one rotating ball 16. Generally, the interruption will be cyclical as the ball or balls rotate when the flow is at constant pressure and volume. The interrupted flow pattern leaves an opening for the relatively easy egress of cut or broken material to get out of the way, so cutting or cleaning action is not hampered by a continuous flow of high-pressure water. The ball-track assembly 10 can be inserted into an existing flow tube such as a nozzle, or incorporated into a new flow tube design by coupling with the flow tube by inserting or integrally forming therewith.

The ball-track assembly 10 relies on track support 12 to locate its position in chamber 21 in body 23 of a flow tube 20, such as a nozzle body. Track support 12 can be of nearly any shape that reliably locates ball-track 17 in chamber 21, with sufficient annular space to allow the flow of fluid through body 23 with moderate to minimal obstruction and resultant pressure loss. An advantageous radial position of ball-track 17 is substantially at the longitudinal axis 13 of chamber 21, where the ball-track 17 produces an annular space between ball-groove 15, which in at least one embodiment can form a central post having a concave surface to engage the ball, and chamber 21. From an axial position perspective, track support 12 naturally creates a front chamber 27 and a rear chamber 25 within chamber 21. Ball-track 17 and ball or balls 16 can be placed in either rear chamber 25 as shown in FIG. 13, or front chamber 27 as shown in FIG. 11, or both, and be within the spirit of the invention.

Ball 16 is optimally of a size smaller than the space between ball-track 17 and rear chamber 25 or front chamber 27, allowing free orbital movement of the ball 16 around the axis of ball-track 17, with axial constraints bounded by the proximal side of ball groove 15 and the distal side of ball groove 15 on the other. The radial constraints are bounded by the shallowest portion of ball groove 15 and the perimeter of rear chamber 25 or front chamber 27.

In the embodiment shown in FIG. 13, the diameter of ball 16 is slightly smaller than annulus space between ball groove 15 and rear chamber 25, but the ball 16 can be any size that fits into the annulus space, yet not of such size that the ball will fall out of the proximal inlet end of nozzle body 23. An advantageous material for ball 16 is ceramic due to its light weight and durability, but there is a variety of materials that could be used. It is clear that the boundaries created by the proximal and distal sides of ball groove 15 and the annulus space between ball groove 15 and chamber 21 can be duplicated in multiple ways while preserving the intent of the described invention, so long as there is free orbital movement of the ball 16 around ball-track 17 in ball groove 15. Similarly, ball 16 is not limited to a single instance. Multiple instances of ball 16 can be inserted in either the proximal side of track-support 12, the distal side of track-support 12, or both, whilst preserving the spirit of this invention. Although not shown, rearward-facing orifices as described in the embodiment of FIG. 11 can also be used in the embodiment of FIG. 13 and other embodiments herein.

Referring again to FIG. 11, the action of the fluid flowing through track-support 12 and over ball 16 produces an orbital motion of ball 16 around ball-track 17. The orbiting ball interrupts the continuous flow of fluid by acting as a barrier to a portion of the flow through chamber 25 and through flow tube orifice 26. The interrupted flow in one section of the swirling fluid produces a gap in the flow stream profile, so the stream is no longer continuous. There is a corresponding higher concentration of jet energy in the remainder of the flow tube orifice 26. Testing has shown that the gap in the fluid through the flow tube orifice 26 is preserved through to the material being cut or cleaned, where it produces a very high impingement force on the material being cut or cleaned.

Referring to FIG. 10 and FIG. 12, track support 12 and ball-track 17 can include an center orifice 19 to allow fluid flow through their collective center to produce a fluid jet that improves nozzle performance for any flow tube orifice 26 that are collinear with center orifice 19.

Figure 14:
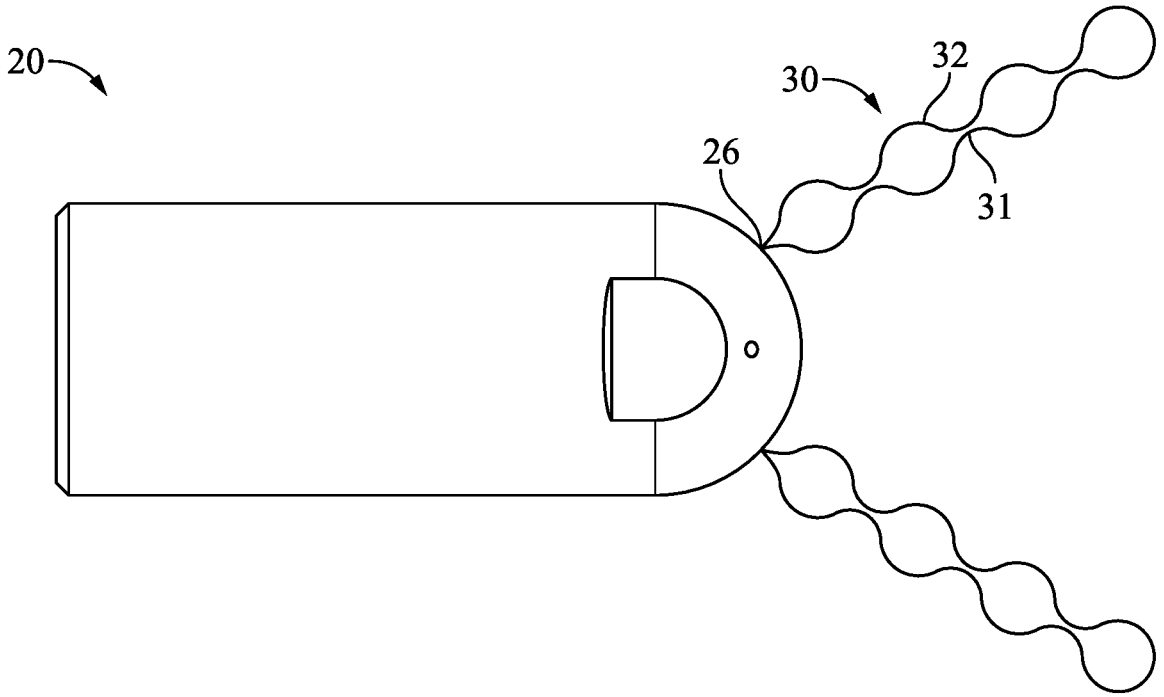
FIG. 14 is a schematic side view of the flow tube of FIGS. 11 and 13 illustrating an example of an interrupted flow with an interrupting trailing edge.

FIG. 14 is a schematic side view of the flow tube of FIGS. 11 and 13 illustrating an example of an interrupted flow with an interrupting trailing edge. The flow tube 20 has a flow tube orifice 26 through which a fluid flows and establishes a flow pattern 30 that is dependent on orifice design. The flow interruption of an otherwise continuous stream caused by the rotating ball(s) described above creates an interruption 31 in the flow. For purposes herein, an "interruption" includes a change or break of a different pressure/energy level in the stream in an otherwise continuous uniform flow. For illustrative purposes, the interruptions 31 shown in FIG. 14 has noticeable changes or gradients of pressure/energy levels, such as pressure waves, in the flow stream that varies in cyclical fashion. The flow stream may not have such cycles or variations and could have more distinct breaks of different pressure/energy levels in an otherwise uniform flow stream.

The interruption's trailing edge 32 (and start of the next fluid flow leading edge) has significant energy. The increased energy helps the flow stream perform at an unexpected level of efficiency. The efficiency is seen experimentally as increased rates of performance at the same pressure or equal rates of performance at a reduced pressure. Results have shown in some cases at least a 500% increase in performance over a similar flow tube without the ball-track assembly with the rotating ball(s).

In summary, two benefits of the present invention are interruptions in the flow to increase jet efficiency on impact surfaces, and an interrupted flow pattern that leaves an "opening" in the flow for easy egress of cut or broken material. The fluid first gets interrupted by the balls, then the pressure fluctuations propagate through the flow tube and impact on the work surface, and the resulting lower pressure regions in the flow provide the opportunity for broken or cut material to evacuate the cut area more easily than if the flow stream has uniform pressure/energy.

Figure 15:
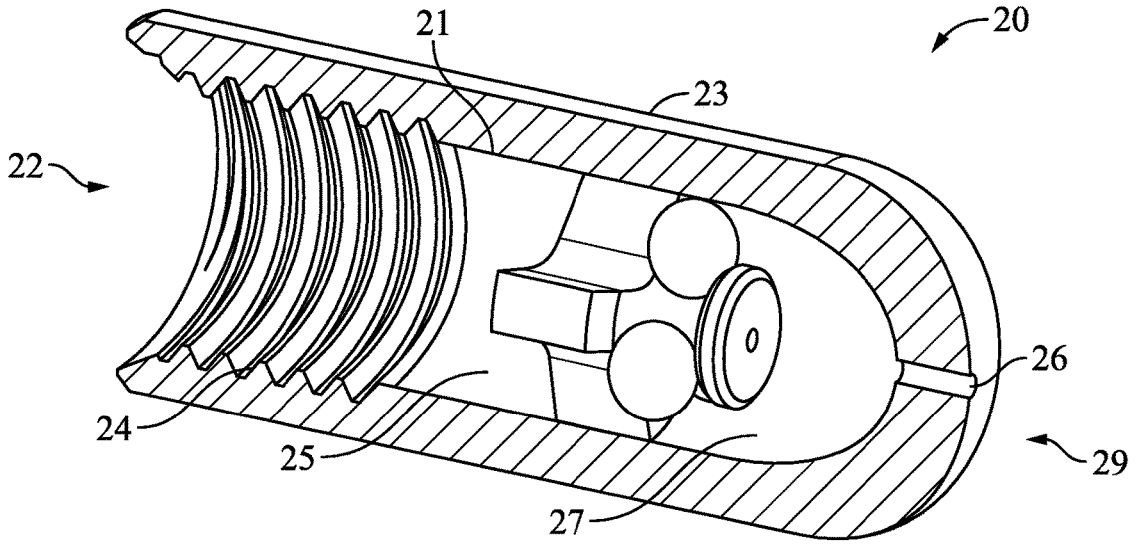
FIG. 15 is a schematic cross-sectional view of another example of a high-pressure flow tube with the ball-track coupled thereto with a central outlet opening designed for a spread jet pattern.

FIG. 15 is a schematic cross-sectional view of another example of a high-pressure flow tube with the ball-track coupled thereto with a central outlet opening designed for a spread jet pattern. The flow tube resembles the prior described flow tube but has a shaped orifice 26 that produces a distributed flow pattern, including a cone, rather than a narrower pattern illustrated in FIG. 14.

Figure 16:
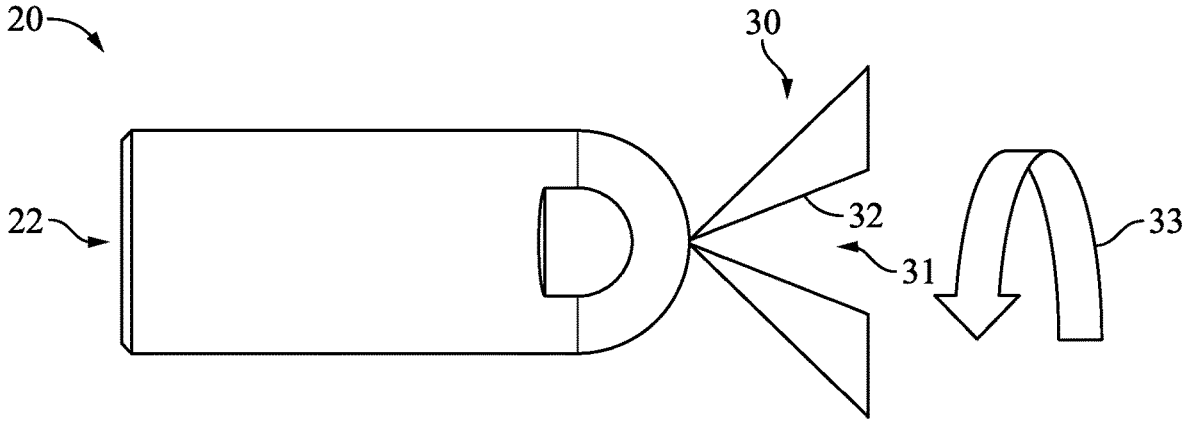
FIG. 16 is a schematic side view of the flow tube of FIG. 15 illustrating another example of an interrupted flow with an interrupting trailing edge.

FIG. 16 is a schematic side view of the flow tube of FIG. 15 illustrating another example of an interrupted flow with an interrupting trailing edge. The flow tube 20 has a flow tube orifice 26 through which a fluid flows and establishes an illustrative distributed flow pattern 30 that is dependent on orifice design. For purposes of illustration, the ball orbit direction 33 is clockwise when viewed from the proximal inlet end 22. The distributed flow pattern 30 is interrupted by the rotating ball(s) described above and can interrupt a portion of the pattern around the pattern. The flow interruption of an otherwise continuous stream caused by the rotating ball(s) described above creates an interruption 31 in the flow can cause a temporary gap in the pattern. The interruption's trailing edge 32 (and start of the next fluid flow leaving edge) has significant energy, as described above, and is believed to contribute substantially to the unexpected high percentage of increased performance of the present invention. While not illustrated, it is possible that both operating environments illustrating in FIGS. 14 and 15 could occur on the flow stream with the rotating ball(s) interrupting the flow stream.

Other and further embodiments utilizing one or more aspects of the inventions described above can be devised without departing from the disclosed invention as defined in the claims. For example, various shapes of flow tubes, various sizes and numbers of extensions for the track support, number of ball-track assemblies in a flow tube, various fluids other than those having water, and other variations can occur in keeping within the scope of the claims.

The invention has been described in the context of advantageous and other embodiments, and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalents of the following claims.

What is claimed is:

1. A flow tube configured to flow an interrupted flow of fluid, comprising: a body having an inlet end and an outlet end, the body having a longitudinal axis and forming a chamber fluidicly coupled between the inlet end and the outlet end; and a ball-track assembly comprising a track support coupled at least partially across the chamber, a ball-track coupled to the track support and protruding along the longitudinal axis, the ball-track forming a fixed width circular path and a central post having a ball groove for at least one ball in an annular space within the chamber in which the at least one ball can orbit the ball-track as fluid flows through the chamber and intersect the fluid flow, the body configured to allow the fluid from the inlet end to communicate longitudinally towards the ball-track assembly and the ball-track and ball configured to directly interrupt a uniform fluid flow toward the outlet end as the ball rotates around the ball track.

2. The flow tube of claim 1, wherein the interrupted flow of fluid is cyclically interrupted.

3. The flow tube of claim 1, wherein the flow tube forms a nozzle with a restricted outlet end flow.

4. The flow tube of claim 1, wherein the ball-track assembly comprises a plurality of balls.

5. The flow tube of claim 1, wherein the flow tube is formed with angled openings toward the inlet end through a wall of the flow tube and fluidicly coupled to the chamber.

6. The flow tube of claim 1, wherein the track support of the ball-track assembly is coupled in the flow tube facing towards the inlet end.

7. The flow tube of claim 1, wherein the track support of the ball-track assembly is coupled in the flow tube facing towards the outlet end.

8. The flow tube of claim 1, wherein the ball-track assembly is formed with a center orifice to create a fluid jet through the ball-track assembly toward the outlet end.

9. The flow tube of claim 1, wherein the interrupted flow of fluid creates an interrupted trailing edge.

10. A method of interrupting a flow stream through a flow tube having a body having an inlet end and an outlet end, the body having a longitudinal axis and forming a chamber fluidicly coupled between the inlet end and the outlet end;

and a ball-track assembly comprising a track support coupled at least partially across the chamber, a ball-track coupled to the track support and protruding along the longitudinal axis, the ball-track forming a fixed width circular path and a central post having a ball groove for at least one ball in an annular space within the chamber in which the at least one ball can orbit the ball-track as fluid flows through the chamber, the method comprising: flowing a fluid from the inlet end and communicating longitudinally towards the ball-track assembly; causing the at least one ball to orbit the ball-track and intersect the flowing fluid; directly interrupting the flowing fluid from a uniform flow in the chamber with the at least one ball as the ball orbits the ball-track; and allowing the interrupted flowing fluid to exit the chamber through the outlet end.

11. The method of claim 10, wherein interrupting the flowing fluid from a uniform flow comprises cyclically interrupting the flowing fluid with the at least one ball as the ball orbits the ball-track.

12. The method of claim 10, wherein a portion of the flowing fluid exits the chamber in a direction toward the inlet end.

13. The method of claim 10, wherein the fluid is a liquid.

14. The method of claim 10, wherein flowing the fluid from the inlet end further comprises flowing the fluid from the inlet end longitudinally past the ball-track assembly; and wherein causing at least one ball to orbit the ball-track further comprises causing the at least one ball to orbit the ball-track by the longitudinal flow;

wherein interrupting the flowing fluid from a uniform flow in the chamber with the at least one ball as the ball orbits the ball-track further comprises interrupting the longitudinally flowing fluid from the uniform flow in the chamber with the at least one ball as the ball orbits the ball-track; and wherein allowing the interrupted flowing fluid to exit the chamber through the outlet end further comprises allowing the interrupted fluid flowing longitudinally past the ball-track assembly to exit the chamber through the outlet end.

15. A method of interrupting a flow stream through a flow tube having a body having an inlet end and an outlet end, the body having a longitudinal axis and forming a chamber fluidicly coupled between the inlet end and the outlet end; and a ball-track assembly comprising a track support coupled at least partially across the chamber, a ball-track coupled to the track support and protruding along the longitudinal axis, the ball-track forming a fixed width circular path and a central post having a ball groove for at least one ball in an annular space within the chamber in which the at least one ball can orbit the ball-track as fluid flows through the chamber, the method comprising: flowing a fluid from the inlet end and communicating longitudinally towards the ball-track assembly; causing the at least one ball to orbit the ball-track with the longitudinal fluid flow and intersect the longitudinal fluid flow; interrupting the longitudinally flowing fluid from a uniform flow in the chamber with the at least one ball as the ball orbits the ball-track; and allowing the interrupted fluid flowing longitudinally past the ball-track assembly to exit the chamber through the outlet end.

16. The method of claim 15, wherein interrupting the flowing fluid from a uniform flow comprises cyclically interrupting the flowing fluid with the at least one ball as the ball orbits the ball-track.

17. The method of claim 15, wherein a portion of the flowing fluid exits the chamber in a direction toward the inlet end.

18. The method of claim 15, wherein interrupting the longitudinally flowing fluid from a uniform flow in the chamber with the at least one ball as the ball orbits the ball-track further comprises directly interrupting the longitudinally flowing fluid from a uniform flow in the chamber with the at least one ball as the ball orbits the ball-track.

19. The flow tube of claim 1, wherein the ball-track comprises the central post with the ball groove forming a concave surface around the central post.

20. The method of claim 15, wherein the ball-track comprises the central post with the ball groove forming a concave surface around the central post.

* * * * *